United States Patent [19]

Berthier et al.

[11] 4,236,462

[45] Dec. 2, 1980

[54] FOLDING TEA TROLLEY

[76] Inventors: Marc A. Berthier, 141 Bd. Saint-Michel, 75005 Paris; Alain Y. Chauvel, 49 rue des Rigoles, 75020 Paris, both of France

[21] Appl. No.: 934,064

[22] Filed: Aug. 16, 1978

[30] Foreign Application Priority Data

Jul. 24, 1978 [FR] France ..... 78 22066

[51] Int. Cl.[3] ..... A47B 3/00

[52] U.S. Cl. ..... 108/111; 280/651; 280/641

[58] Field of Search ..... 108/111, 121, 123; 280/641, 642, 651, 654; 297/58, 50

[56] References Cited

U.S. PATENT DOCUMENTS

| | | | |
|---|---|---|---|
| 493,709 | 3/1893 | Harpfer | 297/58 |
| 2,381,574 | 8/1945 | Clarin | 297/58 |
| 2,419,790 | 4/1947 | Peltier | 280/642 |
| 2,509,107 | 5/1950 | O'Connor | 297/58 |
| 3,074,734 | 1/1963 | Munson et al. | 280/641 |

FOREIGN PATENT DOCUMENTS

| | | | |
|---|---|---|---|
| 240000 | 9/1925 | United Kingdom | 280/651 |
| 515076 | 11/1939 | United Kingdom | 297/58 |

*Primary Examiner*—Francis K. Zugel
*Attorney, Agent, or Firm*—Holman & Stern

[57] ABSTRACT

The invention relates to the wood or metal furniture industry. A folding tea trolley comprises two parallel trays, comprising a front frame and a rear frame with U-shaped lower parts, pivoting means for the rear frame and the trays, on the front frame, and temporary connecting means for the rear frame with the trays, so that in the folded position of the table, the front frame contains the lower tray in its plane and the rear frame and the upper tray are situated on both sides of the plane of the front frame and in planes parallel to the latter. The invention is used for serving trolleys.

4 Claims, 6 Drawing Figures

FOLDING TEA TROLLEY

BACKGROUND OF THE INVENTION

1. Field of the Invention

The present invention relates to the wood or metal furniture industry and more particularly to folding tea trolleys.

2. Description of the Prior Art

Numerous folding tea trolleys exist on the market. Certain of them fold in the direction of the width, others have trays which fold back. All however present the drawback of having a considerable thickness in the folded position.

It is a particular object of the present invention to provide a folding tea trolley which overcomes this drawback.

GENERAL DESCRIPTION OF THE INVENTION

According to the invention there is provided a folding tea trolley, including two parallel trays, characterized in that it comprises a front frame and a rear frame with lower U-shaped parts, articulation means for the rear frame and the trays on the front frame, and temporary connecting means for the rear frame with the trays, such that, in the folded position of the table, the trolley is folded into three parallel planes wherein the front frame contains the lower tray in its plane, and the rear frame and the upper tray are situated on both sides of the plane of the front frame, in planes parallel to the latter, with the upper tray having a portion projecting forwardly from the frames completely free of obstruction of the front portion, whereby access to the front portion is facilitated during use.

According to one feature of the invention, the frames are of wood and all of the same thickness. This arrangement enables the machining of the frames with a single adjustment of the machines for planing and rubbing-down, and this after assembly and drying of said frames.

This feature may advantageously be extended to the construction of furniture of the same program, and notably to that of chairs such as the one which is the subject of Applicants' concurrently-filed application under the title "Folding Chair".

According to an advantageous feature of the invention, the articulation of the rear frame on the front frame is formed by two flat metal parts of which each is partly imprisoned in a transverse hole of an upright of the front frame and extends, for the rest, into a median cleft of the corresponding upright of the rear frame, in which it is held by a pivot.

For the purpose of standardization, reducing the stocking of numerous parts and the drawbacks of the latter, the invention provides for the use of the same flat parts for forming the articulation of the upper tray on the front frame, the unlockable fastening of the upper tray, in open position of the table, with respect to the rear frame, the folding and the locking in this same position of the lower tray with respect to a longitudinal groove formed in each upright of the rear frame.

The invention also provides for the construction of the trolley of metal. In this case, and as has been selected for the thickness of the wooden elements, the frames will here advantageously be formed from tubes of the same section.

The trolley according to the invention then comprises molded metal parts for the connection of the U-shaped elements and/or the connection and articulation of the frames to each other.

For the manufacture of the table according to the invention, whether it is of wood or of metal, the structural and articulation parts are few in number, which simplifies both the stocking and the machining and assembly.

BRIEF DESCRIPTION OF THE DRAWINGS

The invention will be better understood on reading the description which follows with reference to the accompanying drawings which show, by way of non-limiting example, two embodiments of a trolley according to the invention.

In these drawings.

DESCRIPTION OF PREFERRED EMBODIMENTS

Figure 1:
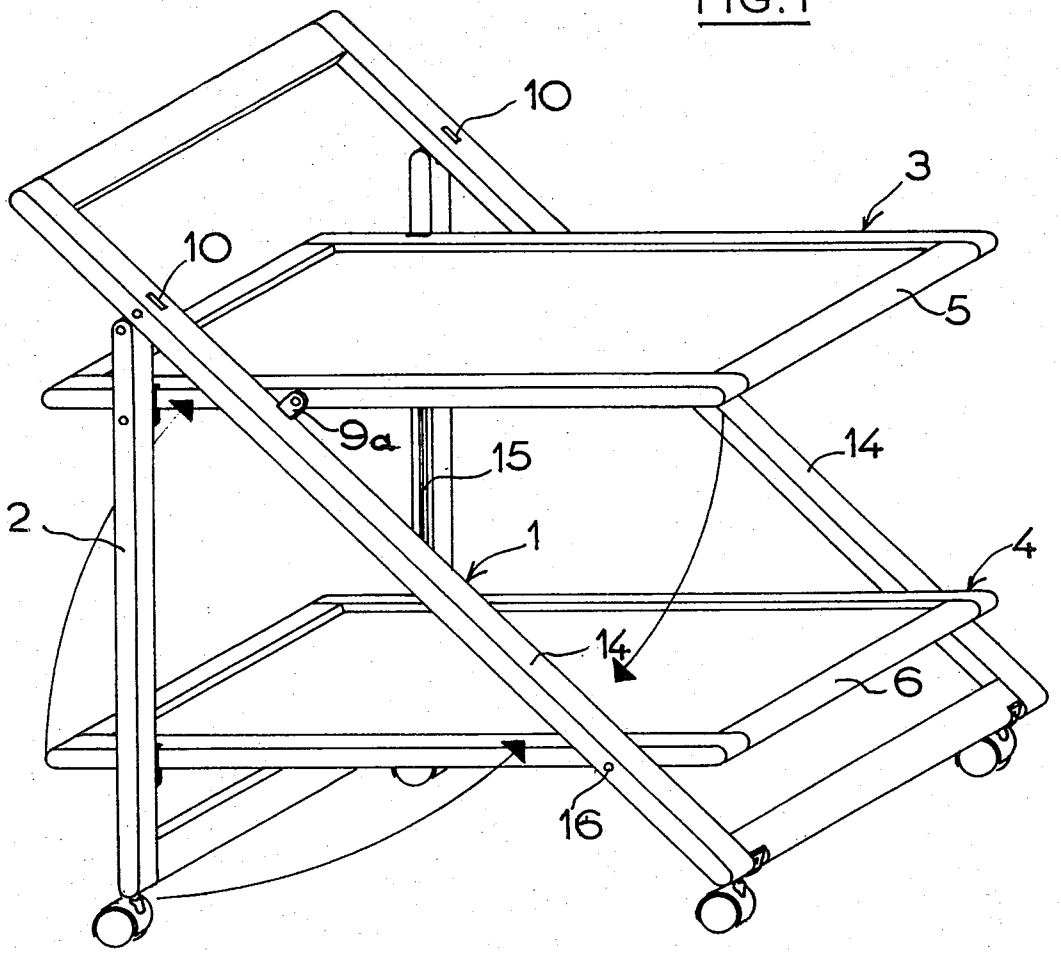
FIG. 1 is a perspective view of a first embodiment of the folding tea trolley according to the invention.
Figure 2:
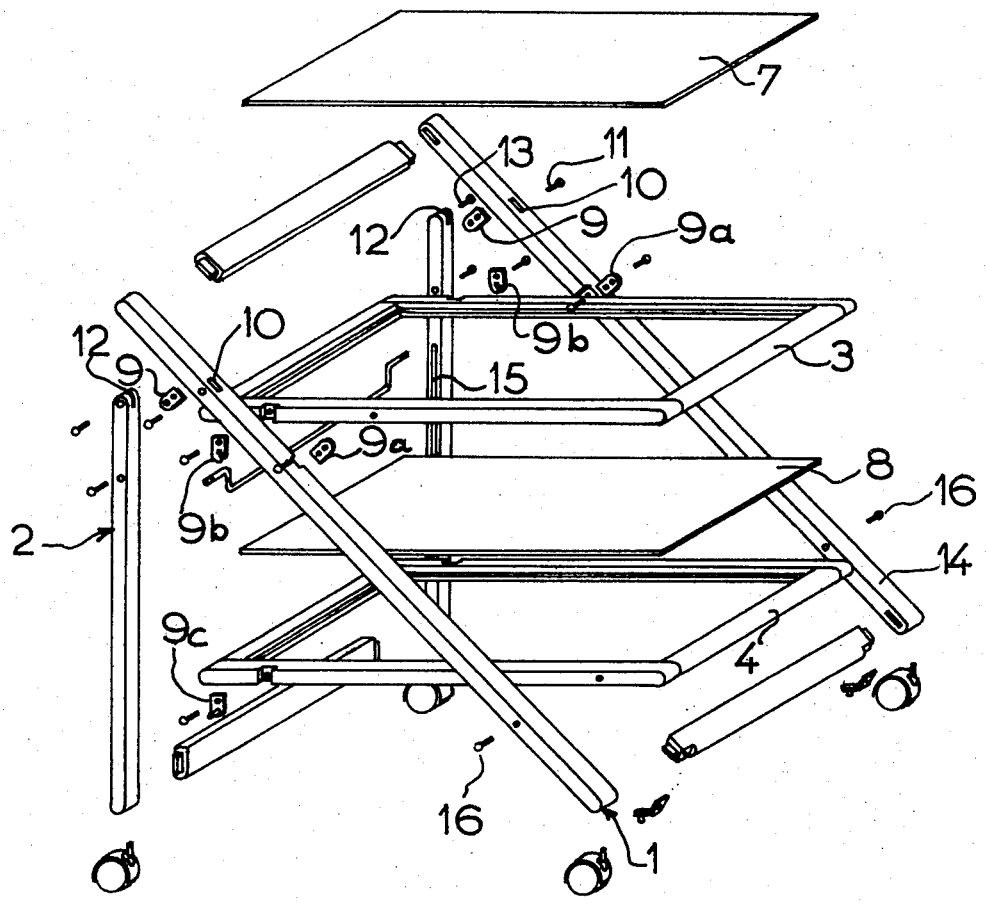
FIG. 2 is an exploded perspective view of the embodiment of the invention in FIG. 1.
Figure 3:
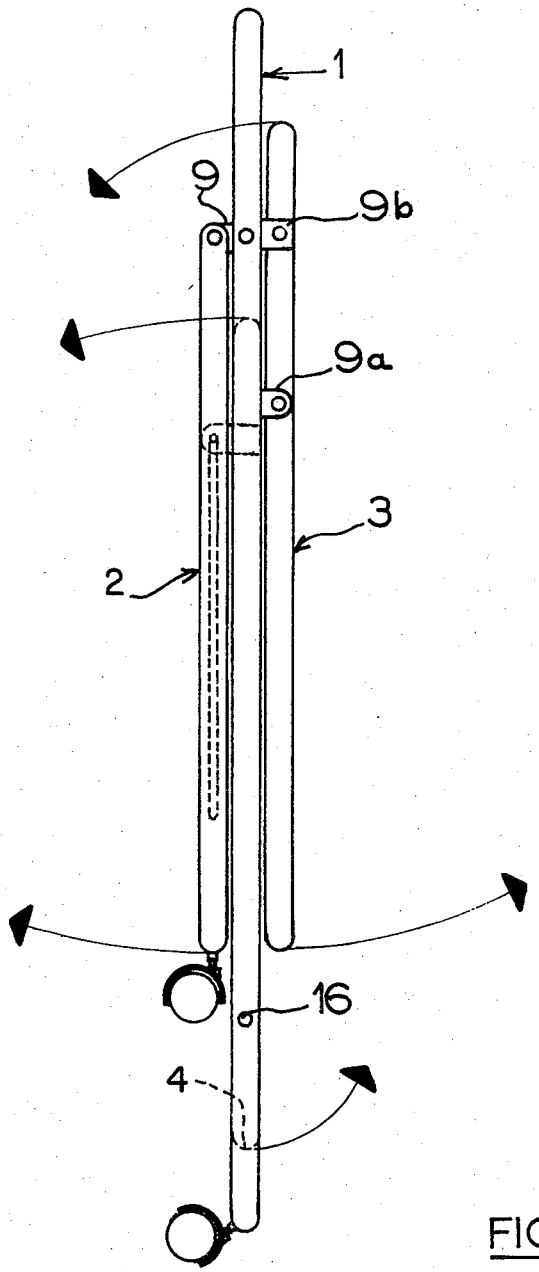
FIG. 3 is a left hand view of the trolley of FIG. 1 in folded position.

The folding tea trolley shown in FIGS. 1 to 3 is of wood and comprises essentially: a front rectangular frame 1, a rear U-shaped frame 2, two trays 3–4 connected to the two preceding frames. Each of the trays 3–4 comprises a frame 5–6, internally grooved and supporting a panel, of wood, laminate, plastics or the like, 7–8.

The four frames have a flat shape and are of the same thickness. They are formed from two sections only of wood, the variable being the width.

The rear frame 2 is articulated on the front frame 1 by two flat metal parts 9 each penetrating partly into a hole 10 formed in each longitudinal upright of the front frame and fixed in this position by a screw 11. The remaining portion of the part 9 extends into a slot 12 formed in the upper part of the uprights of the rear frame and in which it is traversed by a pivot 13.

As shown in FIGS. 1 and 2, the upper ends of the uprights 14 of the front frame 1 extend above and beyond the top of the rear frame 2, and support a cross-member forming a handle.

Parts 9*a*, 9*b*, 9*c*, identical with parts 9 ensuring the articulation between the front 1 and rear 2 frames, form respectively:

the parts 9*a*, the articulation of the upper tray 3, on the front frame 1.

the parts 9*b*, the locking-unlocking of the upper tray 3, in open position of the trolley, with respect to the rear frame 2.

the parts 9*c*, the folding and locking in this same position of the lower tray 4 with respect to a longitudinal groove 15 formed in each upright of the rear frame 2.

The articulation of the lower tray 4 on the front frame 1 is produced by two simple pivots 16.

The assembly of the elements of the folding tea trolley is thus carried out by means of pivoting parts 9 of a single type.

It is seen in FIG. 3 how the preceding embodiment is brought into closed position, in which position it has a thickness reduced to that of the two trays 3–4 and of the front frame 1.

Figure 4:
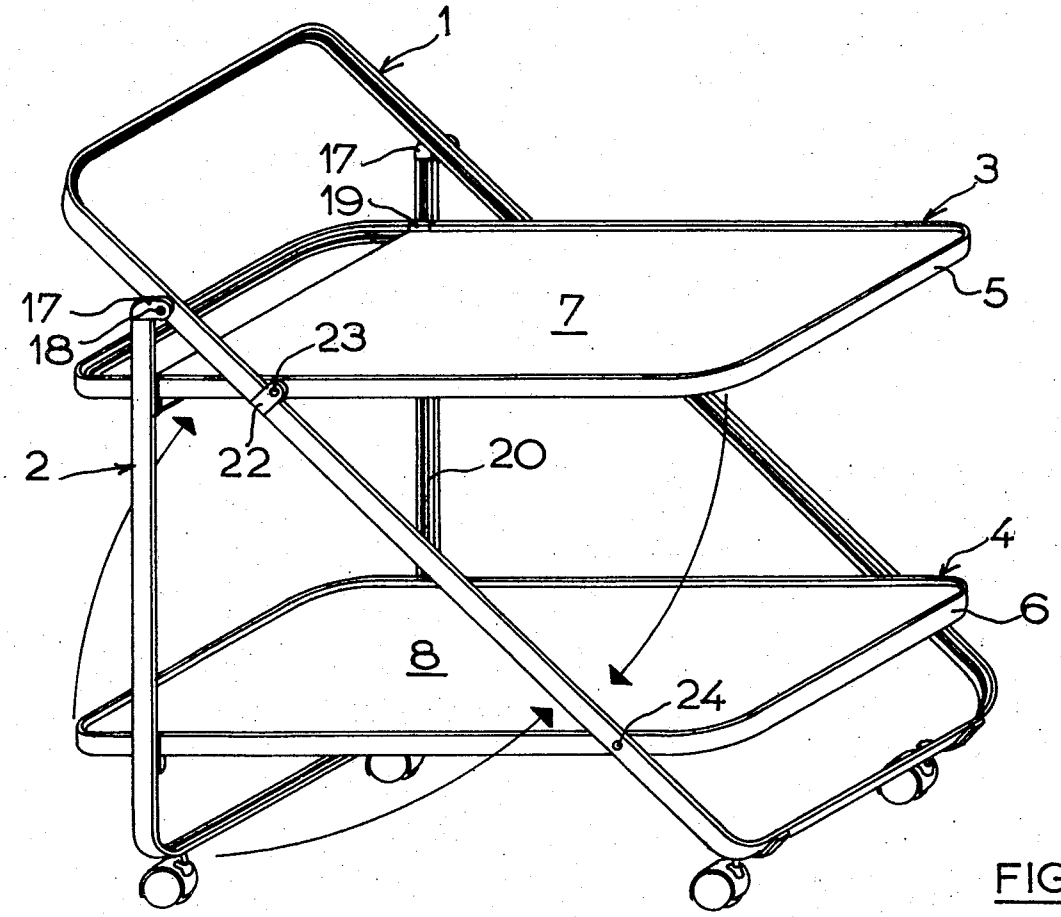
FIG. 4 is a perspective view of a second embodiment of the folding tea trolley according to the invention.
Figure 5:
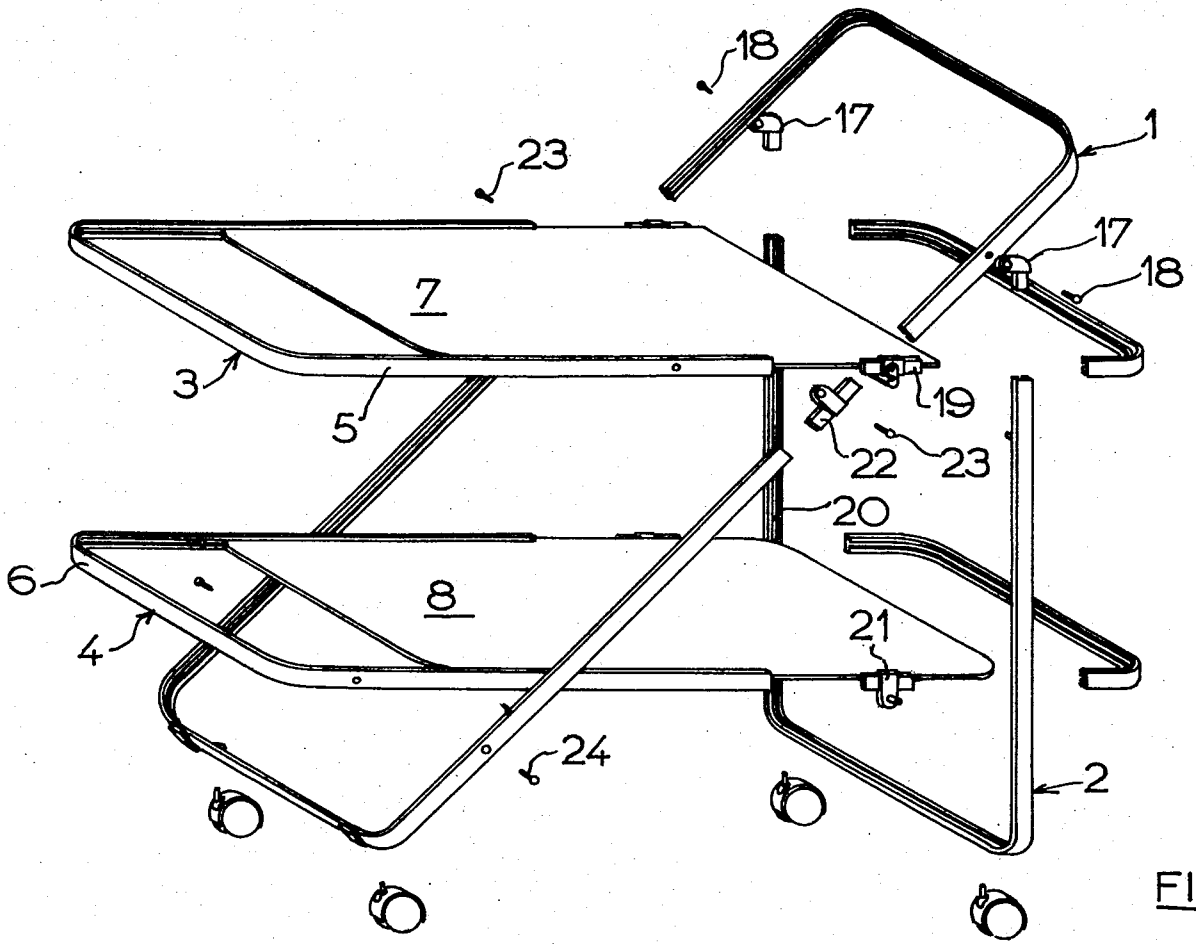
FIG. 5 is an exploded perspective view of the tea trolley of FIG. 4.
Figure 6:
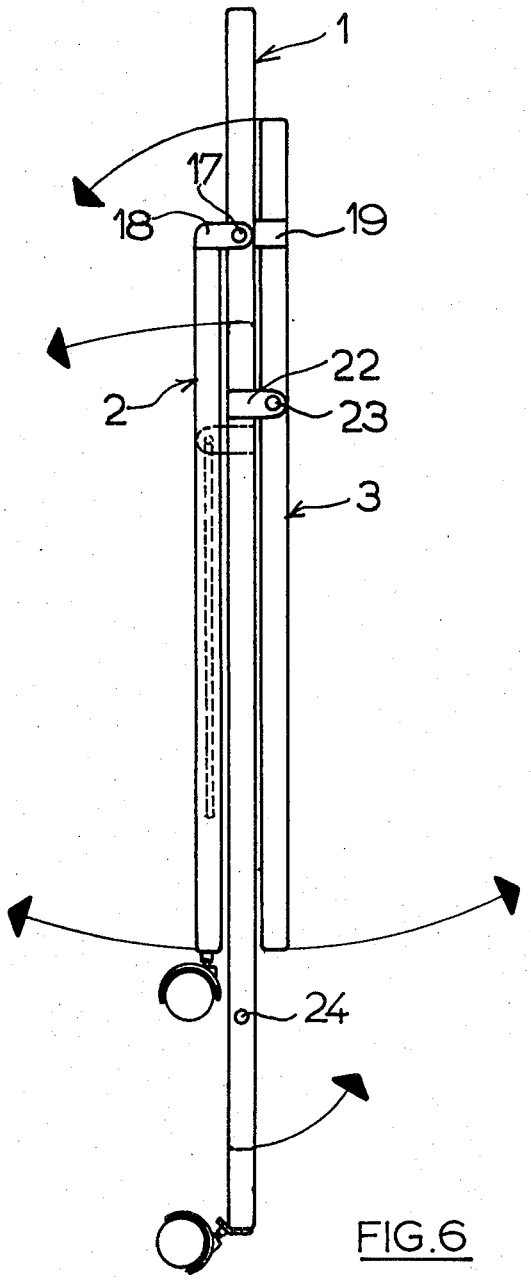
FIG. 6 is a left hand view of the embodiment of FIG. 4 in folded position.

The trolley of FIGS. 4 to 6 is formed of metal tubes of the same section, here provided with a groove formed in manufacture (open tube), tubes cut into U-shapes and curved along the same radius.

Prior to the assembly of the frames to one another, they are assembled with, for the tray, the positioning of the central panels slipped into the grooves of the frames.

The rear frame 2 receives at its upper part two L-shaped molded parts 17, enabling its "offset" articulation to the front frame 1 by pivots 18.

The frame 5 of the upper tray 3, constituted by two U-shaped elements, comprises two straight molded parts 19 each extending into the two sections of the frame and ensuring the locking in the grooves 20 of the rear frame 2.

The frame 6 of the lower tray 4, constituted by two U-shaped elements, comprises two molded parts with a pin 21 connecting the U-shaped elements and positioning the tray 4, each of the pins being introduced and held in one of the two grooves 20 of the rear frame 2.

Finally, the front frame 1, constituted also by two U-shaped elements, includes two molded parts 22 connecting the U-shaped elements and enabling, by pivots 23, the articulation of the upper tray 3.

The articulation of the lower tray 4 on the front frame 1 is simply done by pivots 24.

Wheels are borne by the front and rear frames.

The embodiments of the trolley of FIGS. 4 and 5 is folded as shown in FIG. 6, that is to say, in fact like the preceding trolley described with reference to FIGS. 1 to 3.

According to the invention, the pivoting parts for the wooden trolleys may notably be of phosphated iron, and the pivoting parts for the metal trolleys can, be molded of Zamac or of aluminum.

The panels of the trays may be themselves of any suitable materials, woods, plywood, laminates, plastics, sheet metal, etc. . . .

When the table is produced from "closed" metal tubes, it is possible either to limit the grooves to those necessary, or indeed to channel the tubes over the whole length of the latter.

Of course, the invention is in no way limited to the embodiments described and illustrated; it is capable of numerous modifications apparent to the technician skilled in the art according to the uses envisaged and without departing however from the scope of the invention.

We claim:

1. A folding trolley comprising a planar front frame of substantially rectangular shape and including a pair of side members, a planar rear frame substantially inverted U-shape and including a further pair of side members, said side members of said rear frame being pivotally connected at one end thereof to said side members of said front frame for movement between an open position in which said rear frame is at an angle to said front frame and a folded position in which said rear frame is parallel to said front frame adjacent one surface of said front frame, a lower tray, means pivotally connecting said lower tray to said front frame between said side members of said front frame for movement between a folded position in which said lower tray is substantially coplanar with said front frame and an open position at an angle to said front frame, means providing a support between said rear frame and said lower tray, an upper tray, means pivotally connecting said upper tray between the side members of said front frame in spaced relation to said lower tray for movement between a folded position in which the trolley is folded into three parallel planes wherein the front frame contains the lower tray in its plane and the rear frame and said upper tray are situated on opposite sides of and substantially parallel to said front frame and an open position in which said upper tray is substantially parallel to said lower tray in its open position and releasable attachment means between said upper tray and said rear frame for releasably holding said upper tray in its open position, said upper tray in said open position having a front portion projecting forwardly from the frames completely free of obstruction of the front portion, whereby access to the front portion of the upper tray is facilitated during use, further whereby said upper tray and said lower tray are rotatable in opposite directions between said open and said folded positions, and wherein said means providing support between said rear frame and said lower tray comprises a sliding connection between said rear frame and said lower tray and wherein said sliding connection comprises groove means formed in said rear frame and groove engaging means on said lower tray.

2. The trolley of claim 1 wherein the front frame includes a handle-forming transverse member connected between the side members of the front frame above said upper tray and wherein each tray comprises a rectangular peripheral frame and a tray-forming panel carried by said peripheral frame and wherein each said peripheral frame has internal groove means and the edges of said panels fit in said groove means.

3. The trolley of claim 1 wherein said front and rear frames and said upper and lower trays are made of wood and are all of substantially the same thickness.

4. The trolley of claim 1 wherein said front and rear frames are made of metal tubes and wherein said upper and lower trays each include a peripheral frame made of like metal tubes to the tubes of the front and rear frames.

* * * * *